US008826980B2

(12) United States Patent
Neer

(10) Patent No.: US 8,826,980 B2
(45) Date of Patent: Sep. 9, 2014

(54) ACTIVATION-INDICATING WELLBORE STIMULATION ASSEMBLIES AND METHODS OF USING THE SAME

(75) Inventor: Adam Kent Neer, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 299 days.

(21) Appl. No.: 13/434,584

(22) Filed: Mar. 29, 2012

(65) Prior Publication Data

US 2013/0255938 A1 Oct. 3, 2013

(51) Int. Cl.
*E21B 34/00* (2006.01)
*E21B 43/00* (2006.01)

(52) U.S. Cl.
USPC ..... 166/255.1; 166/66; 166/332.1

(58) Field of Classification Search
USPC ..... 166/255.1, 66, 373, 332.1, 334.4
See application file for complete search history.

(56) References Cited

U.S. PATENT DOCUMENTS

| | | | | |
|---|---|---|---|---|
| 1,773,941 | A | 8/1930 | Boynton | |
| 2,727,778 | A | 12/1955 | MacKnight | |
| 4,574,882 | A | 3/1986 | Szarka | |
| 4,991,653 | A | 2/1991 | Schwegman | |
| 5,394,941 | A | 3/1995 | Venditto et al. | |
| 5,494,105 | A | 2/1996 | Morris | |
| 5,549,161 | A | 8/1996 | Gomez et al. | |
| 5,564,502 | A | 10/1996 | Crow et al. | |
| 5,823,265 | A | 10/1998 | Crow et al. | |
| 6,494,256 | B1 * | 12/2002 | Achee et al. | 166/51 |
| 6,725,929 | B2 * | 4/2004 | Bissonnette et al. | 166/278 |
| 6,989,764 | B2 | 1/2006 | Thomeer et al. | |
| 6,995,352 | B2 | 2/2006 | Hay et al. | |
| 7,000,698 | B2 | 2/2006 | Mayeu et al. | |
| 7,195,033 | B2 | 3/2007 | Mayeu et al. | |
| 7,219,730 | B2 | 5/2007 | Tilton et al. | |
| 7,669,651 | B1 | 3/2010 | Carstensen | |
| 7,712,538 | B2 | 5/2010 | Fay | |

(Continued)

FOREIGN PATENT DOCUMENTS

| | | |
|---|---|---|
| GB | 2376034 A | 12/2002 |
| WO | 0173423 A1 | 10/2001 |

OTHER PUBLICATIONS

Foreign communication from a related counterpart application—International Search Report and Written Opinion, PCT/US2013/025828, Dec. 18, 2013, 12 pages.

(Continued)

*Primary Examiner* — Daniel P Stephenson
(74) *Attorney, Agent, or Firm* — John Wustenberg; Conley Rose, P.C.

(57) ABSTRACT

A wellbore servicing apparatus is disclosed that includes a housing having one or more ports, a first sliding sleeve that is movable from a first position to a second position, a second sliding sleeve that is movable from a first position to a second position, a chamber within the housing, and an indicator within the chamber. When the first sliding sleeve is in the first position, the ports are obstructed and the second sliding sleeve is retained in the first position. When the first sliding sleeve is in the second position, the ports are unobstructed and the second sliding sleeve is not retained in the first position. When the second sliding sleeve is in the first position, the indicator is retained within the chamber. When the second sliding sleeve is in the second position, the indicator is not retained in the chamber.

24 Claims, 6 Drawing Sheets

(56) References Cited

U.S. PATENT DOCUMENTS

| | | | | |
|---|---|---|---|---|
| 7,714,741 | B2 | 5/2010 | Snider et al. | |
| 7,730,968 | B2 | 6/2010 | Hosie et al. | |
| 7,810,564 | B2 | 10/2010 | Montgomery et al. | |
| 7,814,981 | B2 | 10/2010 | Marcu | |
| 7,845,416 | B2 | 12/2010 | Turner et al. | |
| 8,272,443 | B2 | 9/2012 | Watson et al. | |
| 2008/0236819 | A1 | 10/2008 | Foster et al. | |
| 2009/0151939 | A1 | 6/2009 | Bailey et al. | |
| 2010/0044034 | A1 | 2/2010 | Bailey et al. | |
| 2010/0044041 | A1 | 2/2010 | Smith et al. | |
| 2011/0017458 | A1 | 1/2011 | East, Jr. et al. | |
| 2012/0006562 | A1 | 1/2012 | Speer et al. | |
| 2012/0061105 | A1 | 3/2012 | Neer et al. | |
| 2013/0020088 | A1* | 1/2013 | Dyer et al. | 166/373 |
| 2013/0048298 | A1* | 2/2013 | Merron et al. | 166/373 |
| 2013/0255938 | A1* | 10/2013 | Neer | 166/255.1 |
| 2014/0060852 | A1* | 3/2014 | Smith et al. | 166/373 |

OTHER PUBLICATIONS

"Omega Tracer Deployment Valve (TDV)," XP054975262, Oct. 2, 2009, 1 page, http://www.youtube.com/watch?v=9nBh22_7EfA, Omega Completion Technology, Ltd.

* cited by examiner

ACTIVATION-INDICATING WELLBORE STIMULATION ASSEMBLIES AND METHODS OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

Additionally, in some wellbores, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be produced from the wellbore. Some pay zones may extend a substantial distance along the length of a wellbore. In order to adequately induce the formation of fractures within such zones, it may be advantageous to introduce a stimulation fluid via multiple stimulation assemblies positioned within a wellbore adjacent to multiple zones. To accomplish this, it is necessary to configure multiple stimulation assemblies for the communication of fluid via those stimulation assemblies.

An activatable stimulation tool may be employed to allow selective access to one or more zones along a wellbore. However, it is not always apparent when or if a particular one, of sometimes several, of such activatable stimulation tools has, in fact, been activated, thereby allowing access to a particular zone of a formation. As such, where it is unknown whether or not a particular downhole tool has been activated, it cannot be determined if fluids thereafter communicated into a wellbore, for example in the performance of a servicing operation, will reach the formation zone as intended.

As such, there exists a need for a downhole tool, particularly, an activatable stimulation tool, capable of indicating to an operator that it, in particular, has been activated and will function as intended, as well as methods of utilizing the same in the performance of a wellbore servicing operation.

SUMMARY

Disclosed herein is a wellbore servicing apparatus comprising a housing, the housing defining an axial flowbore and comprising one or more ports providing a route of fluid communication between the axial flowbore and an exterior of the housing, a first sliding sleeve, the first sliding sleeve being movable from a first position to a second position, a second sliding sleeve, the second sliding sleeve being movable from a first position to a second position, a chamber, the chamber being at least partially defined by the housing, and an indicator, wherein the indicator is disposed within the chamber, wherein, when the first sliding sleeve is in the first position, the ports are obstructed by the first sliding sleeve and the second sliding sleeve is retained in the first position by the first sleeve and, when the first sliding sleeve is in the second position, the ports are unobstructed by the first sliding sleeve and the second sliding sleeve is not retained in the first position by the first sleeve, and wherein, when the second sliding sleeve is in the first position, the identifier tag is retained within the chamber and, when the second sliding sleeve is in the second position, the indicator is not retained in the chamber.

Also disclosed herein is a wellbore servicing method comprising positioning a wellbore servicing apparatus within a wellbore, the wellbore servicing apparatus comprising a housing, the housing defining an axial flowbore and comprising one or more ports providing a route of fluid communication between the axial flowbore and an exterior of the housing, a first sliding sleeve, the first sliding sleeve being movable from a first position to a second position, a second sliding sleeve, the second sliding sleeve being movable from a first position to a second position, a chamber, the chamber being at least partially defined by the housing, and an indicator, wherein the indicator is disposed within the chamber, transitioning the first sliding sleeve from (a) the first position in which the ports are obstructed by the first sliding sleeve and the second sliding sleeve is retained in the first position by the first sleeve to (b) the second position in which the ports are unobstructed by the first sliding sleeve and the second sliding sleeve is not retained in the first position by the first sleeve, transitioning the second sliding sleeve from (a) the first position in which the indicator is retained within the chamber to (b) the second position in which the indicator is not retained in the chamber, verifying release of the indicator from the chamber, and communicating a wellbore servicing fluid via the ports.

Further disclosed herein is a wellbore servicing method comprising activating a downhole tool by transitioning the tool from a first mode to a second mode, wherein an indicator associated with the downhole tool is released into the wellbore upon activation of the downhole tool, and detecting the indicator at a location uphole from the downhole tool, wherein detection of the indicator provides confirmation of the activation of the downhole tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
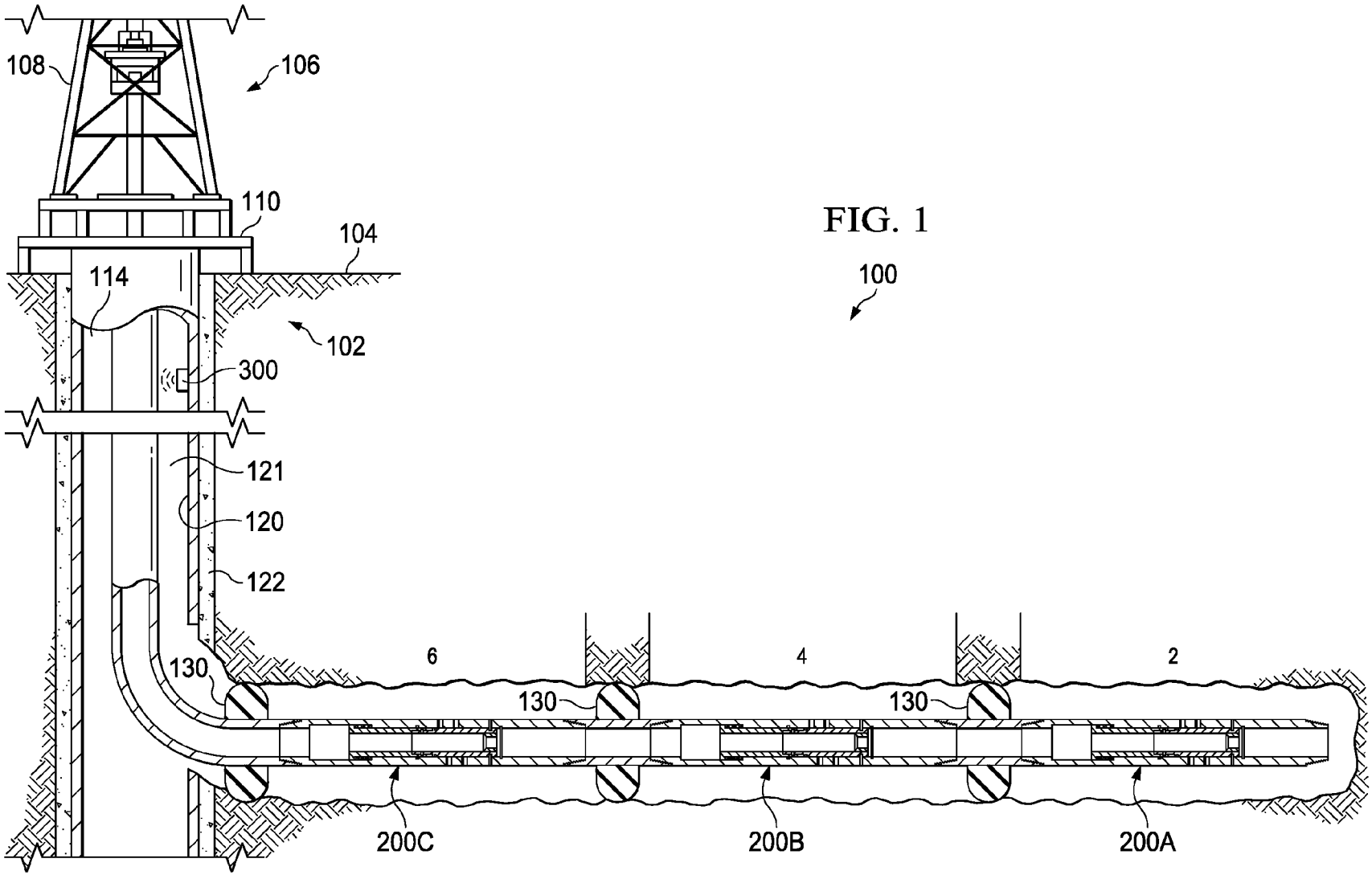
FIG. 1 is partial cut-away view of an embodiment of an environment in which at least one activation-indicating stimulation assembly (ASA) may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more embodiments of a wellbore servicing system comprising one or more activation-indicating stimulation assemblies (ASAs), configured for selective activation in the performance of a wellbore servicing operation.

Referring to FIG. 1, an embodiment of an operating environment in which such a wellbore servicing apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 comprising a plurality of formation zones 2, 4, and 6 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig comprises a derrick with a rig floor through which a work string (e.g., a drill string, a tool string, a segmented tubing string, a jointed tubing string, or any other suitable conveyance, or combinations thereof) generally defining an axial flowbore may be positioned within or partially within the wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into the wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved and such wellbore may be cased, uncased, or combinations thereof.

In an embodiment, the wellbore 114 may be at least partially cased with a casing string 120 generally defining an axial flowbore 121. In an alternative embodiment, a wellbore like wellbore 114 may remain at least partially uncased. The casing string 120 may be secured into position within the wellbore 114 in a conventional manner with cement 122, alternatively, the casing string 120 may be partially cemented within the wellbore, or alternatively, the casing string may be uncemented. For example, in an alternative embodiment, a portion of the wellbore 114 may remain uncemented, but may employ one or more packers (e.g., Swellpackers™ commercially available from Halliburton Energy Services, Inc.) to isolate two or more adjacent portions or zones within the wellbore 114. In an embodiment, a casing string like casing string 120 may be positioned within a portion of the wellbore 114, for example, lowered into the wellbore 114 suspended from the work string. In such an embodiment, the casing string may be suspended from the work string by a liner hanger or the like. Such a liner hanger may comprise any suitable type or configuration of liner hanger, as will be appreciated by one of skill in the art with the aid of this disclosure.

Referring to FIG. 1, a wellbore servicing system 100 is illustrated. In the embodiment of FIG. 1, the wellbore servicing system 100 comprises a first, second, and third ASA, denoted 200*a*-200*c*, respectively, incorporated within the casing string 120 and each positioned proximate and/or substantially adjacent to one of subterranean formation zones (or "pay zones") 2, 4, and 6. Although the embodiment of FIG. 1 illustrates three ASAs (e.g., each being positioned substantially proximate or adjacent to one of three formation zones), one of skill in the art viewing this disclosure will appreciate that any suitable number of ASAs may be similarly incorporated within a casing such as casing string 120, for example, 2, 3, 4, 5, 6, 7, 8, 9, 10, etc. ASAs. Additionally, although the embodiment of FIG. 1 illustrates the wellbore servicing system 100 incorporated within casing string 120, a similar wellbore servicing system may be similarly incorporated within another casing string (e.g., a secondary casing string), or within any suitable work string (e.g., a drill string, a tool string, a segmented tubing string, a jointed tubing string, a coiled-tubing string, or any other suitable conveyance, or combinations thereof), as may be appropriate for a given servicing operation. Additionally, while in the embodiment of FIG. 1, a single ASA is located and/or positioned substantially adjacent to each zone (e.g., each of zones 2, 4, and 6); in alternative embodiments, two or more ASAs may be positioned proximate and/or substantially adjacent to a given zone, alternatively, a given single ASA may be positioned adjacent to two or more zones.

In the embodiment of FIG. 1, the wellbore servicing system 100 further comprises a plurality of wellbore isolation devices 130. In the embodiment of FIG. 1, the wellbore isolation devices 130 are positioned between adjacent ASAs 200*a*-200*c*, for example, so as to isolate the various formation zones 2, 4, and/or 6. Alternatively, two or more adjacent formation zones may remain unisolated. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof.

In one or more of the embodiments disclosed herein, one or more of the ASAs (cumulatively and non-specifically referred to as an ASA 200) may be configured to be activated while disposed within a wellbore like wellbore 114 and to indicate when such activation has occurred. In an embodiment, an ASA 200 may be transitionable from a "first" mode or configuration to a "second" mode or configuration and from the second mode or configuration to a "third" mode or configuration.

Figure 2A:
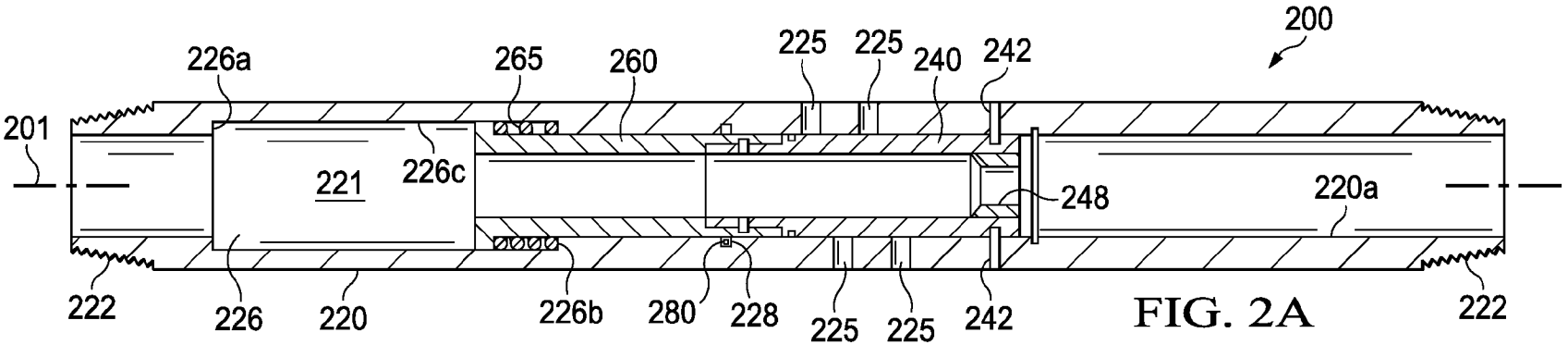
FIG. 2A is a cross-sectional view of an embodiment of an ASA in a first, installation configuration.

Referring to FIG. 2A, an embodiment of an ASA 200 is illustrated in the first mode or configuration. In an embodiment, when the ASA 200 is in the first mode or configuration, also referred to as a run-in or installation mode, the ASA 200 will not provide a route of fluid communication from the flowbore 121 of the casing string 120 to the proximate and/or substantially adjacent zone of the subterranean formation 102 and the ASA will retain an indicator, as will be described herein.

Figure 2B:
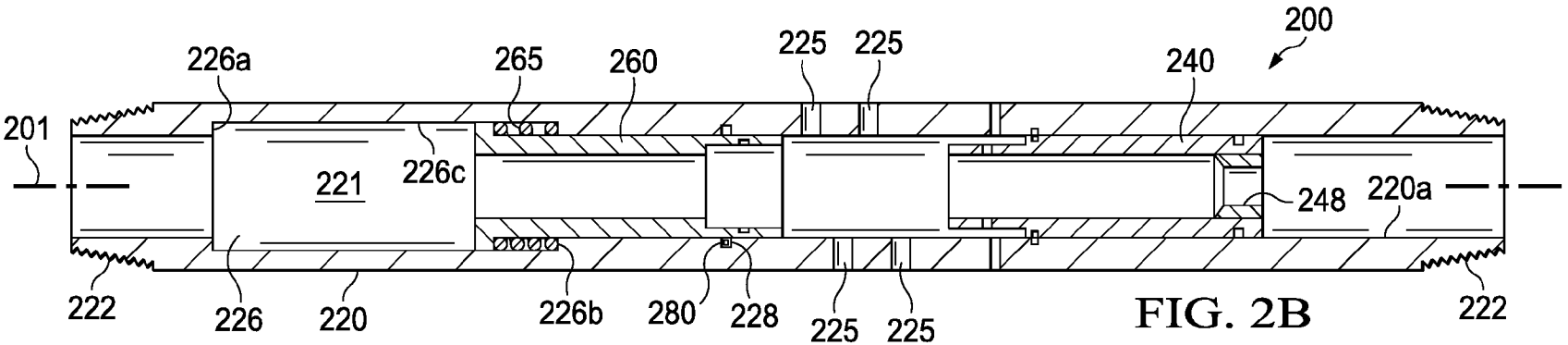
FIG. 2B is a cross-sectional view of an embodiment of the ASA of FIG. 1 in a second, activated configuration.

Referring to FIG. 2B, an embodiment of an ASA 200 is illustrated in the second mode or configuration. In an embodiment, when the ASA 200 is in the second mode or configuration, also referred to as a semi-activated mode, the ASA 200 will provide a route of fluid communication from the flowbore 121 of the casing 120 to the proximate and/or substantially adjacent zone of the subterranean formation 102 and the ASA will retain an indicator, as will be described herein.

Figure 2C:
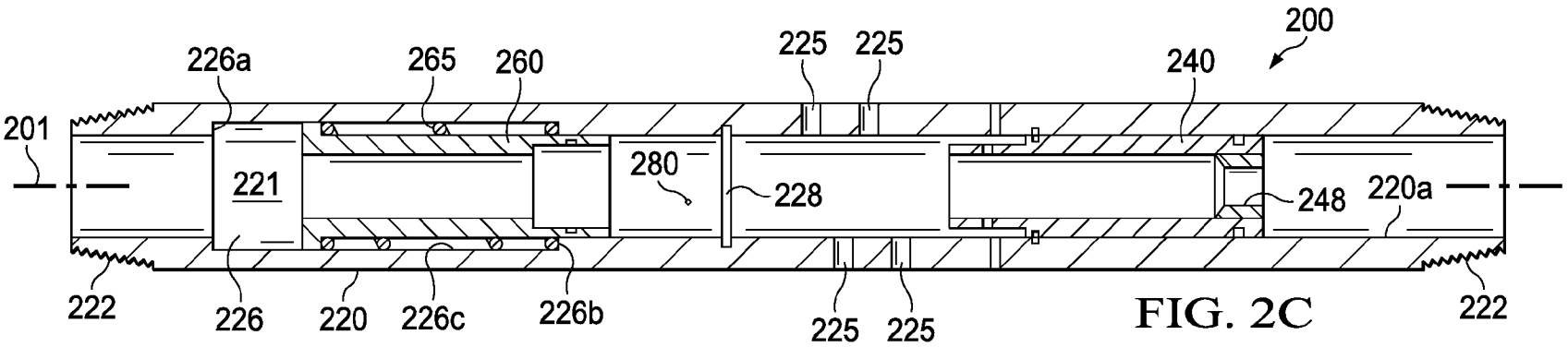
FIG. 2C is a cross-sectional view of an embodiment of the ASA of FIG. 1 in a third, reporting configuration.

Referring to FIG. 2C, an embodiment of an ASA 200 is illustrated in the third mode or configuration. In an embodiment, when the ASA 200 is in the third mode or configuration, also referred to as an activated or reporting mode, the ASA will provide a route of fluid communication from the flowbore 121 of the casing 120 to the proximate and/or substantially adjacent zone of the subterranean formation 102 and the ASA will release the indicator, thereby signaling that the ASA has been transitioned to the third, activated mode, as will be described herein.

Referring to the embodiments of FIGS. 2A, 2B, and 2C, the ASA 200 generally comprises a housing 220, a first sliding sleeve 240, a second sliding sleeve 260, and an indicator 280. The ASA 200 may be characterized as having a longitudinal axis 201.

In an embodiment, the housing 220 may be characterized as a generally tubular body generally defining a longitudinal, axial flowbore 221. In an embodiment, the housing 220 may be configured for connection to and/or incorporation within a string, such as the casing string 120 or, alternatively, a work string. For example, the housing 220 may comprise a suitable means of connection to the casing string 120 (e.g., to a casing member such as casing joint or the like). For example, in the embodiment of FIGS. 2A, 2B, and 2C, the terminal ends of the housing 220 comprise one or more internally and/or externally threaded surfaces 222, for example, as may be suitably employed in making a threaded connection to the casing string 120. Alternatively, an ASA like ASA 200 may be incorporated within a casing string (or other work string) like casing string 120 by any suitable connection, such as, for example, via one or more quick-connector type connections. Suitable connections to a casing member will be known to those of skill in the art viewing this disclosure. The axial flowbore 221 may be in fluid communication with the axial flowbore 121 defined by the casing string 120. For example, a fluid communicated via the axial flowbores 121 of the casing will flow into and via the axial flowbore 221.

In an embodiment, the housing 220 may comprise one or more ports 225 suitable for the communication of fluid from the axial flowbore 221 of the housing 220 to a proximate subterranean formation zone when the ASA 200 is so-configured. For example, in the embodiment of FIG. 2A, the ports 225 within the housing 220 are obstructed by the first sliding sleeve 240, as will be discussed herein, and will not communicate fluid from the axial flowbore 221 to the surrounding formation. In the embodiment of FIGS. 2B and 2C, the ports 225 within the housing 220 are unobstructed, as will be discussed herein, and may communicate fluid from the axial flowbore 221 to the surrounding formation 102. In an embodiment, the ports 225 may be fitted with one or more pressure-altering devices (e.g., nozzles, erodible nozzles, or the like). In an additional embodiment, the ports 225 may be fitted with plugs, screens, covers, or shields, for example, to prevent debris from entering the ports 225.

In an embodiment, the housing 220 may comprise a unitary structure (e.g., a continuous length of pipe or tubing or a mandrel); alternatively, the housing 220 may comprise two or more operably connected components (e.g., two or more coupled sub-components, such as by a threaded connection). Alternatively, a housing like housing 220 may comprise any suitable structure; such suitable structures will be appreciated by those of skill in the art upon viewing this disclosure.

In an embodiment, the housing may comprise an inner bore surface 220*a*, the inner bore surface generally defining the axial flowbore 221. In an embodiment, the housing 220 may generally define a recessed, second sliding sleeve bore 226. The sleeve bore 226 may generally comprise a passageway (e.g., a circumferential recess extending a length parallel to the longitudinal axis 201) in which the second sliding sleeve 260 may move longitudinally, axially, radially, or combinations thereof within the axial flowbore 221. In the embodiments of FIGS. 2A, 2B, and 2C, the second sliding sleeve bore 226 is generally defined by an upper shoulder 226*a*, a lower shoulder 226*b*, and a recessed bore surface 226*c* extending there-between, that is, between the upper shoulder 226*a* and the lower shoulder 226*b*. In an embodiment, the second sliding sleeve bore 226 may comprise one or more grooves, guides, or the like (e.g., longitudinal grooves), for example, to align and/or orient the second sliding sleeve 260 via a complementary structure (e.g., one or more lugs, pegs, grooves, or the like) on the second sliding sleeve 260.

In an embodiment, the housing 220 further comprises an indicator chamber 228. In various embodiments, the indicator chamber may be generally configured to receive, retain, and release, as will be discussed herein, the indicator. As such, the indicator chamber 228 may be sized, shaped, or otherwise configured as may be suitable dependent upon the size, shape, and/or configuration of the indicator employed, as will be disclosed herein. For example, in the embodiment of FIGS. 2A, 2B, and 2C, the indicator chamber is illustrated as a radially-extending recess or groove within the housing 220, more specifically, within the interior bore of the housing 220. In additional or alternative embodiments, the indicator chamber may generally comprise any suitable recess, depression, groove, divot, or the like, as may be apparent to one of skill in the art upon viewing this disclosure. In an embodiment, the indicator chamber 228 may be configured to eject the indicator when the ASA is so-configured, as will be disclosed herein. For example, the indicator chamber 228 may be pressurized, spring-loaded, or the like.

In an embodiment, the first sliding sleeve 240 generally comprises a cylindrical or tubular structure. Referring to the embodiments of FIGS. 3A, 3B, and 3C, the first and second sliding sleeve, 240 and 260, are shown in greater detail. In an embodiment, the first sliding sleeve 240 generally comprises an upper orthogonal face 240*a*, a lower orthogonal face 240*b*, an inner cylindrical surface 240*c* at least partially defining an axial flowbore 241 extending therethrough, an upward-facing shoulder 240*d*, a first outer cylindrical surface 240*e* extending between the upper orthogonal face 240*a* and the shoulder 240*d*, and a second outer cylindrical surface 240*f* extending between the shoulder 240*d* and the lower orthogonal face 240*b*. In an embodiment, the axial flowbore 241 defined by the first sliding sleeve 240 may be coaxial with and in fluid communication with the axial flowbore 221 defined by the housing 220. In the embodiment of FIGS. 2A-2C and 3A-3C, the first sliding sleeve 240 may comprise a single component piece. In an alternative embodiment, a first sliding sleeve like the first sliding sleeve 240 may comprise two or more operably connected or coupled component pieces.

In an embodiment, the first sliding sleeve 240 may be slidably and concentrically positioned within the housing 220. For example, in the embodiment of FIGS. 2A-2C and 3A-3C, the first sliding sleeve 240 may be positioned within the axial flowbore 221 of the housing 220. For example, at least a portion of the second outer cylindrical surface 240*f* of the first sliding sleeve 240 may be slidably fitted against at least a portion of the inner bore surface 220*a* of the housing 220.

In an embodiment, the first sliding sleeve 240, the housing 220, or both may comprise one or more seals at the interface between the outer cylindrical surface 240*f* of the first sliding sleeve 240 and the inner bore surface 220*a*. For example, in an embodiment, the first sliding sleeve 240 may further comprise one or more radial or concentric recesses or grooves configured to receive one or more suitable fluid seals, for example, to restrict fluid movement via the interface between the outer cylindrical surface 240*f* of the sliding sleeve 240 and the inner bore surface 220*a*. Suitable seals include but are not limited to a T-seal, an O-ring, a gasket, or combinations thereof.

In an embodiment, the first sliding sleeve 240 may be slidably movable from a first position to a second position within the housing 220. Referring again to FIGS. 2A and 3A, the first sliding sleeve 240 is shown in the first position. In the embodiment illustrated in FIGS. 2A and 3A, when the first sliding sleeve 240 is in the first position, the first sliding sleeve 240 may obstruct the ports 225 of the housing 220, for example, such that fluid will not be communicated between the axial flowbore 221 of the housing 220 and the proximate and/or substantially adjacent zone of the subterranean formation 102 via the ports 225. In an embodiment, the first sliding sleeve 240 may be held in the first position by suitable retaining mechanism. For example, in the embodiment of FIGS. 2A and 3A, the first sliding sleeve 240 is retained in the first position by one or more frangible members, for example, shear-pins 242 or the like. The shear pins may be received by shear-pin bore within the first sliding sleeve 240 and shear-pin bore in the housing 220. In an embodiment, when the sliding sleeve 240 is in the first position, the ASA 200 is configured in the first mode or configuration.

Referring to FIGS. 2B, 2C, 3B, and 3C the first sliding sleeve 240 is shown in the second position. In the embodiment illustrated in FIGS. 2B, 2C, 3B, and 3C, when the first sliding sleeve 240 is in the second position, the first sliding sleeve 240 does not obstruct the ports 225 of the housing 220, for example, such fluid may be communicated between the axial flowbore 221 of the housing 220 and the proximate and/or substantially adjacent zone of the subterranean formation 102 via the ports 225.

In an embodiment, in the second position the first sliding sleeve 240 may rest against an abutment or the like, for example to restrict the first sliding sleeve 240 from continued downward movement (e.g., movement to the right, as illustrated). For example, in an embodiment, the lower orthogonal face 240*b* of the first sliding sleeve 240 may abut a shoulder, ring, abutment, catch, or the like. Additionally or alternatively, in an embodiment, the first sliding sleeve 240 may be held in the second position by a suitable retaining mechanism. For example, in the embodiment of FIGS. 2B, 2C, 3B, and 3C, the first sliding sleeve 240 is retained in the second position by a snap-ring 245 or the like. The snap-ring may be received and/or carried within snap-ring groove within the first sliding sleeve 240. The snap-ring 245 may expand into a complementary groove 245*a* within the housing 220 when the sliding sleeve 240 is in the second position and, thereby, retain the first sliding sleeve 240 in the second position. With regard to FIGS. 2B, 2C, 3B, and 3C, it is noted that the first sliding sleeve 240 is illustrated as having fully transitioned to the second position before the second sliding sleeve 260 begins to transition from its first position to its second position, as will be discussed herein. The movement of first sliding sleeve 240 and the second sliding sleeve 260 from their first positions to their second positions, respectively, may at least partially overlap or coincide in time (e.g., about simultaneously or contemporaneously); that is, the illustrations of FIGS. 2B, 2C, 3B, and 3C is intended to illustrate the respective first and second positions, but may not represent the times at which the first and second sliding sleeves move relative to each other. For example, although the first sliding sleeve 240 is illustrated as reaching its second position before the second sliding sleeve 260 departs from its first position, in an embodiment, the second sliding sleeve 260 may depart its first position before the first sliding sleeve 240 reaches its second position. In other words, sleeves may move opposite one another about simultaneously or contemporaneously.

In an alternative embodiment, a first sliding sleeve like first sliding sleeve 240 may comprise one or more ports suitable for the communication of fluid from the axial flowbore 221 of the housing 220 and/or the axial flowbore 241 of the first sliding sleeve 240 to a proximate subterranean formation zone when the master ASA 200 is so-configured. For example, in an embodiment where such a first sliding sleeve is in the first position, as disclosed herein above, the ports within the first sliding sleeve 240 will be misaligned with the ports 225 of the housing and will not communicate fluid from the axial flowbore 221 and/or axial flowbore 241 to the wellbore and/or surrounding formation. When such a first sliding sleeve is in the second position, as disclosed herein above, the ports within the first sliding sleeve will align with the ports 225 of the housing and will communicate fluid from the axial flowbore 221 and/or axial flowbore 241 to the wellbore and/or surrounding formation.

In an embodiment, the first sliding sleeve 240 may be configured to be selectively transitioned from the first position to the second position. For example, in the embodiment of FIGS. 2A-2C and 3A-3C, the first sliding sleeve 240 comprises a seat 248 configured to receive, engage, and/or retain an obturating member (e.g., a ball or dart) of a given size and/or configuration moving via axial flowbores 221 and 241. For example, in an embodiment the seat 248 comprises a reduced flowbore diameter in comparison to the diameter of axial flowbores 221 and/or 241 and a bevel or chamfer 248*a* at the reduction in flowbore diameter, for example, to engage and retain such an obturating member. In such an embodiment, the seat may be configured such that, when the seat engages and retains such an obturating member, fluid movement via the axial flowbores 221 and/or 241 may be impeded, thereby causing hydraulic pressure to be applied to the first sliding sleeve 240 so as to move the first sliding sleeve 240 from the first position to the second position. In an embodiment, the seat 248 may be integral with (e.g., joined as a single unitary structure and/or formed as a single piece) and/or connected to the first sliding sleeve 240. For example, in embodiment, the expandable seat 248 may be attached to the first sliding sleeve. In an alternative embodiment, a seat may comprise an independent and/or separate component from the first sliding sleeve but nonetheless capable of applying a pressure to the first sliding sleeve to transition the first sliding sleeve from the first position to the second position. For example, such a seat may loosely rest against and/or adjacent to the first sliding sleeve.

In an alternative embodiment, a first sliding sleeve may be configured such that the application of a fluid and/or hydraulic pressure (e.g., a hydraulic pressure exceeding a threshold) to the axial flowbore thereof will cause the first sliding sleeve 240 to transition from the first position to the second position. For example, in such an embodiment, the first sliding sleeve may be configured such that the application of fluid pressure to the axial flowbore results in a net hydraulic force applied to the first sliding sleeve in the direction of the second position. For example, the hydraulic forces applied to the first sliding sleeve may be greater in the direction that would move the first sliding sleeve toward the second position than the hydraulic forces applied in the direction that would move the first sliding sleeve away from the second position, as may result from a differential in the surface area of the downward-facing and upward-facing surfaces of the first sliding sleeve. One of skill in the art, upon viewing this disclosure, will appreciate that the first sliding sleeve may be configured for movement upon the application of a sufficient hydraulic pressure.

In another alternative embodiment, a first sliding sleeve may be configured to be engaged and shifted by a shifting tool (e.g., a mechanical shifting tool). In such an embodiment, the first sliding sleeve may comprise one or more lugs, dogs, keys, catches, and/or structures complementary to such lugs, dogs, keys, catches. Suitable shifting tools are disclosed in U.S. patent application Ser. No. 12/358,079 to Smith, et al., and U.S. patent application Ser. No. 12/566,467 to East, et al., each of which is incorporated herein in its entirety. For example, in an embodiment, such a shifting tool may comprise the mechanical shifting tool disclosed in U.S. patent application Ser. No. 12/566,467 to East, et al., with regard to FIGS. 13 and 14 and the associated text.

In an embodiment, the second sliding sleeve 260 generally comprises a cylindrical or tubular structure. Referring again to FIGS. 3A, 3B, and 3C, in an embodiment, the second sliding sleeve 260 generally comprises an upper orthogonal face 260*a*, a lower orthogonal face 260*b*, an inner shoulder 260*c*, a first inner cylindrical surface 260*d* extending between the upper orthogonal face 260*a* and the inner shoulder 260*c*, a second inner cylindrical surface 260*e* at least partially defining the axial flowbore 261 and extending between the inner shoulder 260*c* and the lower orthogonal face 260*b*, an outer shoulder 260*f*, a first outer cylindrical surface 260*g* extending between the upper orthogonal face 260*a* and the shoulder 260*f*, and a second outer cylindrical surface 260*h* extending between the shoulder 260*f* and the lower orthogonal face 260*b*. In an embodiment, the axial flowbore 261 defined by the second sliding sleeve 260 may be coaxial with and in fluid communication with the axial flowbore 221 defined by the housing 220 and the axial flowbore 241 of the first sliding sleeve 240. In the embodiment of FIGS. 2A-2C and 3A-3C, the second sliding sleeve 260 may comprise a single component piece. In an alternative embodiment, a second sliding sleeve like the second sliding sleeve 260 may comprise two or more operably connected or coupled component pieces.

In an embodiment, the second sliding sleeve 260 may be slidably and concentrically positioned within the housing 220. For example, in the embodiment of FIGS. 2A-2C and 3A-3C, the second sliding sleeve 260 may be positioned within the axial flowbore 221 of the housing 220. For example, in the embodiments of FIGS. 2A-2C and 3A-3C, at least a portion of the first outer cylindrical surface 260*g* of the second sliding sleeve may be slidably fitted against at least a portion of the recessed bore surface 226*c* of the housing and at least a portion of the second outer cylindrical surface 260*h* of the second sliding sleeve 260 may be slidably fitted against at least a portion of the inner bore surface 220*a* of the housing 220.

In an embodiment, the second sliding sleeve 260, the housing 220, or both may comprise one or more seals at the interface between the first outer cylindrical surface 260*g* of the second sliding sleeve 260 and the recessed bore surface 226*c*, between the second outer cylindrical surface 260*h* of the second sliding sleeve 260 and the inner bore surface 220*a*, or both. For example, in an embodiment, the second sliding sleeve 260 may further comprise one or more radial or concentric recesses or grooves configured to receive one or more suitable fluid seals, for example, to restrict fluid movement via the interface between the first outer cylindrical surface 260*g* of the second sliding sleeve 260 and the recessed bore surface 226*c*, between the second outer cylindrical surface 260*h* of the second sliding sleeve 260 and the inner bore surface 220*a*, or both. Suitable seals include but are not limited to a T-seal, an O-ring, a gasket, or combinations thereof.

In an embodiment, the second sliding sleeve 260 may be slidably movable from a first position to a second position within the housing 220. Referring again to FIGS. 2A and 3A, the second sliding sleeve 260 is shown in the first position. In the embodiment illustrated in FIGS. 2A and 3A, when the second sliding sleeve 260 is in the first position, the second sliding sleeve 260 may enclose the indicator chamber 228 (e.g., such that the indicator chamber 228 is not open to the axial flowbore 221) of the housing 220. In an embodiment, the second sliding sleeve 260 may be held in the first position by suitable retaining mechanism. For example, in the embodiment of FIGS. 2A and 3A, the second sliding sleeve 260 is retained in the first position by one or more frangible members, for example, shear-pins 262 or the like. The shear pins may be received by shear-pin bore within the second sliding sleeve 260 and shear-pin bore within the first sliding sleeve 240.

Figure 3A:
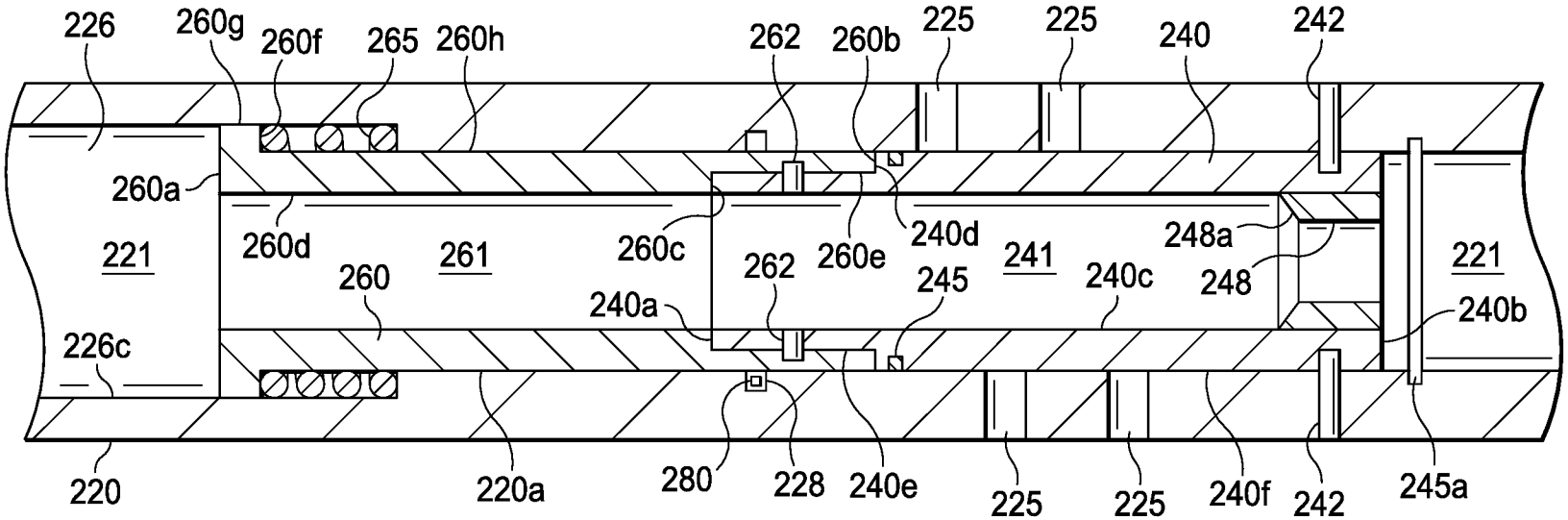
FIG. 3A is a detailed cross-sectional view of an embodiment of an ASA in the first, installation configuration.
Figure 3B:
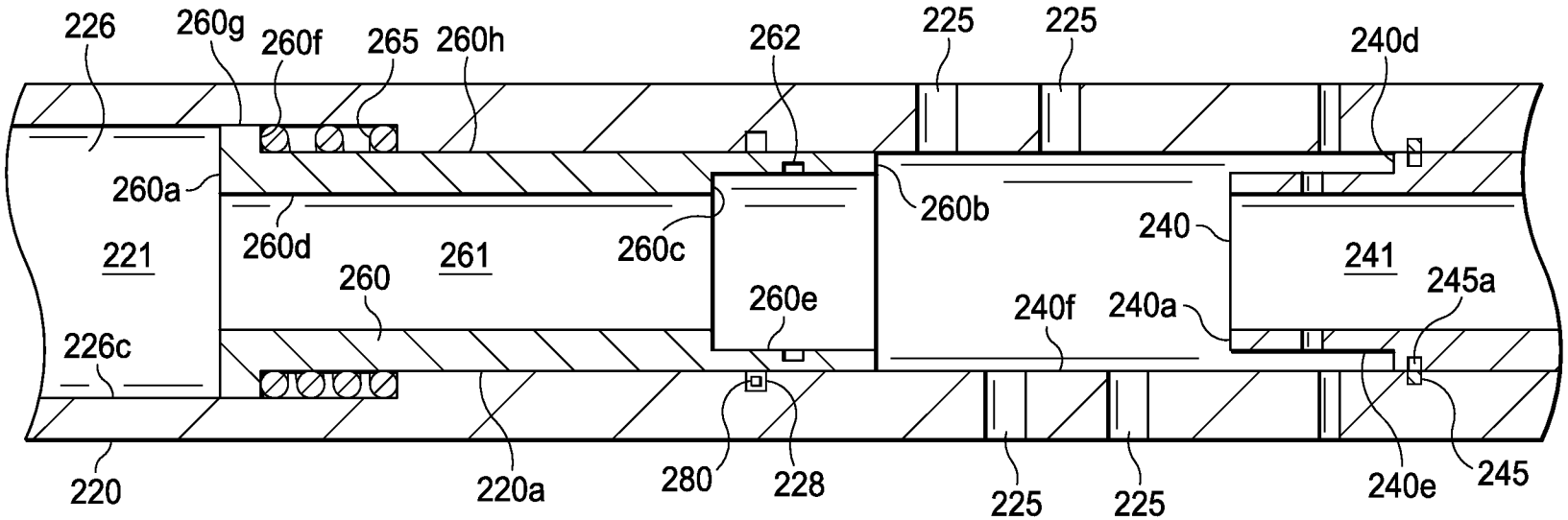
FIG. 3B is a detailed cross-sectional view of an embodiment of the ASA of FIG. 1 in the second, activated configuration.
Figure 3C:
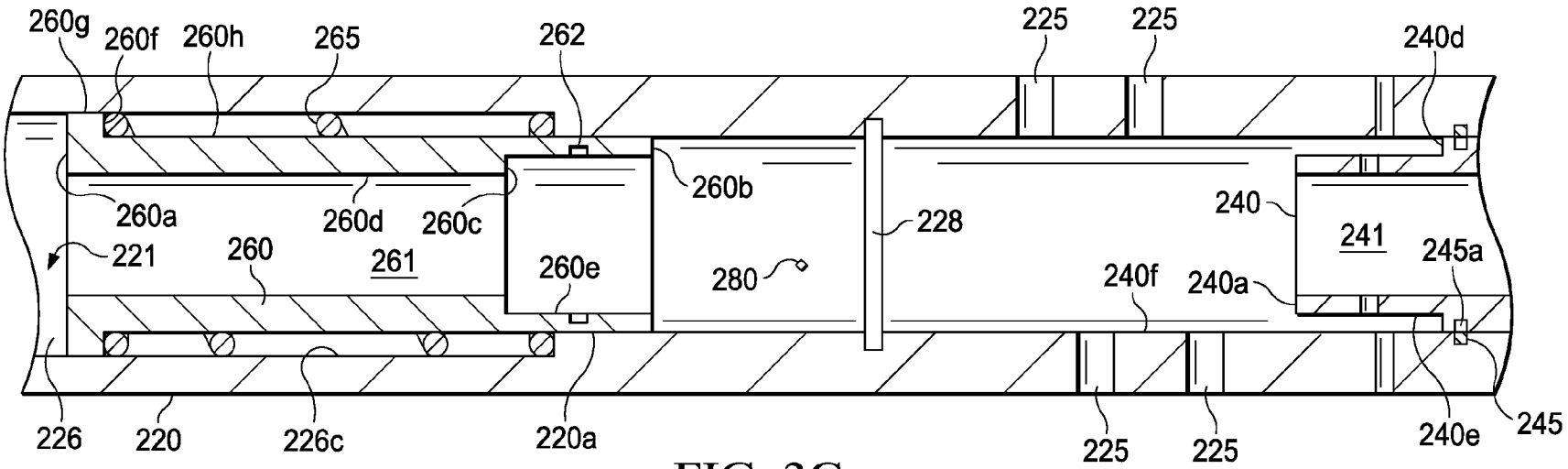
FIG. 3C is a detailed cross-sectional view of an embodiment of the ASA of FIG. 1 in the third, reporting configuration.

Referring to FIGS. 2C and 3C the second sliding sleeve 260 is shown in the second position. As noted above, the order of the movement of first sliding sleeve 240 and the second sliding sleeve 260 from their first positions to their second positions, respectively, may at least partially overlap or coincide in time; the illustrations of FIGS. 2B, 2C, 3B, and 3C is intended to illustrate the respective first and second positions, but may not represent the times at which the first and second sliding sleeves move relative to each other. In the embodiment illustrated in FIGS. 2C and 3C, when the second sliding sleeve 260 is in the second position, the second sliding sleeve 260 does not enclose the indicator chamber 228 (e.g., such that the indicator chamber is open to the axial flowbore 221).

In an embodiment, the second sliding sleeve 260 may be biased toward the second position. For example, in the embodiments of FIGS. 2A-2C and 3A-3C, the second sliding sleeve 260 is biased, via a biasing member 265, such that, if uninhibited, the second sliding sleeve will move toward and reach its second position. In an embodiment, the biasing member 265 generally comprises a suitable structure or combination of structures configured to apply a directional force and/or pressure to the second sliding sleeve 260 with respect to the housing 220. Examples of suitable biasing members include a spring, a compressible fluid or gas contained within a suitable chamber, an elastomeric composition, a hydraulic piston, or the like. For example, in the embodiment of FIGS. 2A-2C and 3A-3C, the biasing member 265 comprises a spring (e.g., a coil spring).

In the embodiment FIGS. 2A-2C and 3A-3C, the biasing member 265 is concentrically positioned within recessed bore 226 of the housing 220. The biasing member 265 may be configured to apply a directional force to the second sliding sleeve 260 with respect to the housing. For example, in the embodiment of FIGS. 2A-2C and 3A-3C, the biasing member 265 is configured to apply an upward (i.e., to the left in the Figures) force, via the first outer cylindrical surface 260*f*, to the second sliding sleeve 265 throughout at least a portion of the length of the movement of the second sliding sleeve 260.

In an embodiment, in the second position the second sliding sleeve 260 may rest against an abutment or the like to restrict the second sliding sleeve 260 from continued downward movement. For example, in the embodiment of FIGS. 2C and 3C, the second sliding sleeve is retained in the second position by the biasing member 265, which is fully extended. Additionally or alternatively, in an embodiment, the upper orthogonal face 260*a* of the second sliding sleeve may abut a shoulder, ring, abutment, catch, or the like. Additionally or alternatively, in an embodiment, the second sliding sleeve may be held in the second position by suitable retaining mechanism. For example, in an embodiment, the second sliding sleeve may be retained in the second position by a snap-ring or the like. The snap-ring pins may be received and/or carried within snap-ring groove within the second sliding sleeve and may expand into a complementary groove within the housing when the second sliding sleeve is in the second position and, thereby, retain the second sliding sleeve in the second position.

In an embodiment, the indicator 280 may generally comprise any suitable device or structure capable of signaling the configuration of a given ASA by its release therefrom. For example, the indicator 280 may signal, by the fact that it is not retained within a given ASA, that such ASA is in a particular configuration, particularly, that the first and/or second sliding sleeves have been transitioned into a particular position (e.g., into their second positions, as disclosed herein). As such, the indicator 280 may signal by its presence at a local other than within the indicator chamber of a given ASA, the configuration a particular ASA.

As such, in an embodiment, the indicator 280 may comprise any suitable device or structure capable of capture and/or detection. In various embodiments, the indicator may generally be characterized as an active signaling device, alternatively, the indicator may generally be characterized as a passive signaling device. In some embodiments, the indicator may be a relatively complex device, while in other embodiments, the indicator may be relatively simple. For example, suitable indicators may include, but are not limited to, tags, balls, blocks, flags, radio-frequency identification (RFID) tags, radio transmitters, microelectromechanical systems (MEMS), acoustic signal transmitting devices, radiation and/or radioactivity-emitters, the like or combinations thereof.

In an embodiment, an indicator may be associated with a given, particular ASA, for example, a particular indicator may be unique to a given ASA. Referring to FIG. 1, in such an embodiment, each of ASAs 200*a*, 200*b*, and 200*c* may comprise an indicator associated therewith, each indicator capable of being distinguished from an indicator associated with any other ASA. For example, where the indicator comprises a relatively simple configuration, such as a tag or flag, the various indicators may be distinguished on the basis of size, color, shape, chemical composition, or some inscription thereon (e.g., an identification number). Alternatively, where the indicator comprises a relatively more complex configuration, such as a RFID tag, a MEMS, of the like, the various indicators may be distinguishable on the basis of the signal (e.g., electronic signal, radio signal, acoustic signal, magnetic strength, or otherwise) and/or data (e.g., identification number) associated therewith. In an alternative embodiment, the indicator may be indistinguishable from the indicator of another ASA. For example, two or more ASAs may comprise and/or be associated with indicators that are indistinguishable.

In an embodiment, the indicator may be configured for and/or capable of detection by a suitable device or instrument. Referring again to FIG. 1, a detector 300 is illustrated disposed within the wellbore 114. For example, such a detector may comprise a scanning device, a straining/filtering device, an interrogation device, a reader, a capturing device (e.g., a magnet), a signal receiving device, or combinations thereof. For example, in an embodiment where the indicator comprises a relatively simple configuration, such as a tag or flag, the indicators may be detected by straining and/or filtering fluids returned from the wellbore for such an indicator and capturing the indicator therefrom. Alternatively, in an embodiment where the indicator comprises a relatively complex configuration, such as an RFID tag or MEMS, the indicators may be detected via a suitable signal receiver, as will be appreciated by one of skill in the art upon viewing this disclosure, when the indicator is within sufficient proximity thereto.

In an embodiment, the detector 300 may be configured to detect the indicator at a given location within and/or without of the wellbore 114. For example, in the embodiment of FIG. 1, the detector is positioned within the wellbore 114, for example, at a particular depth. Alternatively, a detector may be positioned at the surface. In an embodiment, the detector 300 may be configured to detect when an indicator (e.g., indicator 280) comes within a given proximity of the detector. For example, the detector may detect the indicator within a desired range (e.g., within about 1 inches, alternatively, within about 1 foot, alternatively, within about 5 feet, alternatively, within about 10 feet, alternatively, within about 20 feet). In an embodiment, upon detection of an indicator within range, the detector may be configured to output a signal (e.g., a wireless signal, electric signal, electronic signal, acoustic signal, or combinations thereof), capable of indicating to an operator that the indicator has been detected within range of the detector (e.g., and, thus, apart from the ASA).

In various embodiments, the indicator may be configured to interact with the detector at such desired location. For example, where the indicator detecting device is positioned upward (e.g., uphole) relative to the ASAs (e.g., ASAs 200*a*-200*c*) the indicator may be characterized as buoyant, for example, such that the indicator will float in the direction of the detector upon release from a given ASA.

In an alternative embodiment, an ASA may comprise a suitable alternative configuration. For example, in an alternative embodiment, an ASA may be configured to release an indicator, for example, as disclosed herein, upon movement of a first sliding sleeve from a first position to a second position. In such an embodiment, the indicator may be similarly disposed within a chamber obscured by a first sliding sleeve and, the indicator may be released upon movement of the first sliding sleeve to its second position, thereby allowing communication of fluid via ports within the ASA's housing. For example, in such an embodiment, the indictor chamber may be substantially adjacent to the ports, such that the indicator chamber opens substantially contemporaneously with the ports becoming unobscured. Alternatively, the indicator chamber may be longitudinally apart from the ports, for example, in further in the direction of the movement of the sliding sleeve, such that the indicator chamber opens only after the ports have become unobscured. One of skill in the art, upon viewing this disclosure, will appreciate various suitable alternative configurations.

One or more of embodiments of a wellbore servicing system 100 comprising one or more ASAs 200 (e.g., ASAs 200*a*-200*c*) having been disclosed, one or more embodiments of a wellbore servicing method employing such a wellbore servicing system 100 and/or such an ASA 200 are also disclosed herein. In an embodiment, a wellbore servicing method may generally comprise the steps of positioning a wellbore servicing system comprising one or more ASAs within a wellbore such that each of the ASAs is proximate to a zone of a subterranean formation, optionally, isolating adjacent zones of the subterranean formation, transitioning a first sliding sleeve within a first ASA from its first position to its second position, transitioning the second sliding sleeve within the first ASA from its first position to its second position, detecting the configuration of the first ASA, and communicating a servicing fluid to the zone proximate to the first ASA via the first ASA.

In an embodiment, the process of transitioning a first sliding sleeve within an ASA from its first position to its second position, transitioning a second sliding sleeve within the ASA from its first position to its second position, detecting the configuration of that ASA, and communicating a servicing fluid to the zone proximate to the ASA via that ASA, as will be disclosed herein, may be repeated, for as many ASAs as may be incorporated within the wellbore servicing system.

In an embodiment, one or more ASAs may be incorporated within a work string or casing string, for example, like casing string 120, and may be positioned within a wellbore like wellbore 114. For example, in the embodiment of FIG. 1, the casing string 120 has incorporated therein the first ASA 200*a*, the second ASA 200*b*, and the third ASA 200*c*. Also in the embodiment of FIG. 1, the casing string 120 is positioned within the wellbore 114 such that the first ASA 200*a* is proximate and/or substantially adjacent to the first subterranean formation zone 2, the second ASA 200*b* is proximate and/or substantially adjacent to the second zone 4, and the third ASA 200*c* is proximate and/or substantially adjacent to the third zone 6. Alternatively, any suitable number of ASAs may be incorporated within a casing string. In an embodiment, the ASAs (e.g., ASAs 200*a*-200*c*) may be positioned within the wellbore 114 in a configuration in which no ASA will communicate fluid to the subterranean formation, particularly, the ASAs may be positioned within the wellbore 114 in the first, run-in, or installation mode or configuration.

In an embodiment where the ASAs (e.g., ASAs 200*a*-200*c*) incorporated within the casing string 120 are configured for activation by an obturating member engaging a seat within each ASA, as disclosed herein, the ASAs may be configured such that progressively more uphole ASAs are configured to engage progressively larger obturating members and to allow the passage of smaller obturating members. For example, in the embodiment of FIG. 1, the first ASA 200*a* may be configured to engage a first-sized obturating member, while such obturating member will pass through the second and third ASAs, 200*b* and 200*c*, respectively. The second ASA 200*b* may be configured to engage a second-sized obturating member, while such obturating member will pass through the third ASA 200*c*, and the third ASA 200*c* may be configured to engage a third-sized obturating member.

In an embodiment, once the casing string 120 comprising the ASAs (e.g., ASAs 200*a*-200*c*) has been positioned within the wellbore 114, adjacent zones may be isolated and/or the casing string 120 may be secured within the formation. For example, in the embodiment of FIG. 1, the first zone 2 may be isolated from the second zone 4, the second zone 4 from the third zone 6, or combinations thereof. In the embodiment of FIG. 1, the adjacent zones (2, 4, and/or 6) are separated by one or more suitable wellbore isolation devices 130. Suitable wellbore isolation devices 130 are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., 2, 4, and/or 6) may be isolated, alternatively, the zones may remain unisolated. Additionally and/or alternatively, the casing string 120 may be secured within the formation, as noted above, for example, by cementing.

In an embodiment, the zones of the subterranean formation (e.g., 2, 4, and/or 6) may be serviced working from the zone that is furthest down-hole (e.g., in the embodiment of FIG. 1, the first formation zone 2) progressively upward toward the furthest up-hole zone (e.g., in the embodiment of FIG. 1, the third formation zone 6). In alternative embodiments, the zones of the subterranean formation may be serviced in any suitable order. As will be appreciated by one of skill in the art, upon viewing this disclosure, the order in which the zones are serviced may be dependent upon, or at least influenced by, the method of activation chosen for each of the ASAs associated with each of these zones.

In an embodiment, once the casing string comprising the ASAs has been positioned within the wellbore and, optionally, once adjacent zones of the subterranean formation (e.g., 2, 4, and/or 6) have been isolated, the first ASA 200*a* may be prepared for the communication of a fluid to the proximate and/or adjacent zone. In such an embodiment, the first sliding sleeve 240 within the ASA proximate and/or substantially adjacent to the first zone to be serviced (e.g., formation zone 2), is transitioned from its first position to its second position. In an embodiment wherein the ASA is activated by an obturating member engaging a seat within the ASA, transitioning the first sliding sleeve within the ASA 200 to its second position may comprise introducing an obturating member (e.g., a ball or dart) configured to engage the seat of that ASA 200 into the casing string 120 and forward-circulating the obturating member to engage the seat 248 of the ASA.

In such an embodiment, when the obturating member has engaged the seat 248, application of a fluid pressure to the flowbore 221, for example, by continuing to pump fluid may increase the force applied to the seat 248 and the first sliding sleeve 240 via the obturating member. Referring to FIGS. 2B and 3B, application of sufficient force to the first sliding sleeve 240 via the seat 248 (e.g., force sufficient to break shear-pin 242) may cause the shear-pin 242 to shear, sever, or break, allowing the first sliding sleeve 240 to slidably move from the first position (e.g., as shown in FIGS. 2A and 3A) to the second position (e.g., as shown in FIGS. 2B, 2C, 3B, and 3C). In an embodiment, as the first sliding sleeve 240 moves from the first position to the second position, the first sliding sleeve 240 ceases to obscure the ports 225 within the housing 220.

Also, as the first sliding sleeve 240 moves from the first position to the second position, because the first sliding sleeve 240 and the second sliding sleeve 260 are coupled via shear pin 262, the second sliding sleeve 260 may travel (e.g., at least some distance) along with the first sliding sleeve, thereby compressing the biasing member 265. As the biasing member 265 becomes more compressed or fully compressed, the biasing member 265 exerts a force against the second sliding sleeve in the opposite direction of the travel of the first sliding sleeve. Referring to FIGS. 2C and 3C, application of sufficient force in one direction by the biasing member and in the opposite direction by the first sliding sleeve 240 (e.g., force sufficient to break shear-pin 262) may cause shear-pin 262 to shear, sever, or break, allowing the first sliding sleeve 240 to continue to move toward its second position and allowing the second sliding sleeve 260 to move toward its second position. In an additional or alternative embodiment, the second sliding sleeve may abut a shoulder or stop (e.g., which may be a part of the housing 220) to cause the second sliding sleeve to not travel in the direction of the first position of the first sliding sleeve and, thereby, causing shear-pin to shear, sever, or break when the second sliding sleeve reaches such stop.

In an embodiment, as the second sliding sleeve 260 moves from the first position to the second position, (for example, via the extension of the biasing member) the second sliding sleeve 260 ceases to enclose the indicator chamber 228. As such, the indicator chamber 228 is opened to the axial flowbore 221 and the indicator 280 is allowed to escape the indicator chamber 228 into the axial flowbore 221. As noted above, in various embodiments the indicator chamber 228 may be pressurized, spring-loaded, or otherwise configured such that, upon being opened, the indicator 280 is ejected from the indicator chamber 228 into the axial flowbore 221. In an embodiment, an ASA may comprise (e.g., retain within the indicator chamber 228) multiple indicators, which may be similarly released. In such an embodiment, the release of multiple indicators may improve the detection and/or capture of such indicators, as will be discussed below.

In an embodiment, when the indicator 280 (e.g., a unique indicator associated with the first ASA 200*a*) has been released from the ASA (e.g., ASA 200*a*), the indicator 280 may thereafter be detected at another location within the wellbore, the casing string, or at any other locale apart from the ASA. As noted above, detection of the indicator at any such location apart from the ASA may indicate that the second sliding sleeve 260 has been transitioned to its second position, and, thus, that the first sliding sleeve 240 has been transitioned to its second position, and, thus, that the particular ASA is configured to communicate a servicing fluid to the proximate zone or zones of the subterranean formation.

In an embodiment, detection of the indicator, for example, by detector 300, may occur at any suitable point within the wellbore 114 or out of the wellbore 114. For example, in the embodiment of FIG. 1, the detector 300 is positioned at a location up-hole relative to the ASAs. In such an embodiment, the indicator 280 may be allowed to move through the wellbore 114 (e.g., through the casing string 120) to a position where it can detected by the detector 300. For example, where the detector is positioned at a location up-hole relative to the ASAs, the indicator may be allowed to rise (e.g., through buoyancy) through the wellbore. Additionally or alternatively, wellbore fluids may be reverse-circulated to encourage the indicator to move toward the detector.

As noted above, in an embodiment where the indicator comprises a relatively simple configuration, such as a tag or flag, the indicators may be detected by straining and/or filtering fluids returned from the wellbore for such an indicator and capturing the indicator therefrom. Alternatively, in an embodiment where the indicator comprises a relatively complex configuration, such as an RFID tag or MEMS, the indicators may be detected via a suitable signal receiver when the indicator comes within the range of the detector. Upon detecting the indicator at a position apart from the ASA, the operator can be assured that the ASA is configured for the communication of fluids to the proximate zone of the subterranean formation.

In an embodiment, when the operator has confirmed that the first ASA 200*a* is configured for the communication of a servicing fluid, for example, by detection of an indicator associated with the first ASA 200*a* as disclosed herein, a suitable wellbore servicing fluid may be communicated to the first subterranean formation zone 2 via the ports 225 of the first ASA 200*a*. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 102 and/or a zone thereof.

In an embodiment, when a desired amount of the servicing fluid has been communicated to the first formation zone 2, an operator may cease the communication of fluid to the first formation zone 2. Optionally, the treated zone may be isolated, for example, via a mechanical plug, sand plug, or the like, placed within the flowbore between two zones (e.g., between the first and second zones, 2 and 4). The process of transitioning a first sliding sleeve within an ASA from its first position to its second position, transitioning a second sliding sleeve within the ASA from its first position to its second position, detecting the configuration of that ASA, and communicating a servicing fluid to the zone proximate to the ASA via that ASA may be repeated with respect the second and third ASAs, 200*b* and 200*c*, respectively, and formation zones 4 and 6, associated therewith. Additionally, in an embodiment where additional zones are present, the process may be repeated for each of the ASAs and the associated zones.

In an embodiment, an ASA such as ASA 200, a wellbore servicing system such as wellbore servicing system 100 comprising an ASA such as ASA 200, a wellbore servicing method employing such a wellbore servicing system 100 and/or such an ASA 200, or combinations thereof may be advantageously employed in the performance of a wellbore servicing operation. For example, as disclosed herein, as ASA such as ASA 200 may allow an operator to ascertain the configuration of such an ASA while the ASA remains disposed within the subterranean formation. As such, the operator can be assured that a given servicing fluid will be communicated to a given zone within the subterranean formation. Such assurances may allow the operator to avoid mistakes in the performance of various servicing operations, for example, communicating a given fluid to the wrong zone of a formation. In addition, the operator can perform servicing operations with the confidence that the operation is, in fact, reaching the intended zone.

Additional Disclosure

The following are nonlimiting, specific embodiments in accordance with the present disclosure:

Embodiment A. A wellbore servicing apparatus comprising:

a housing, the housing defining an axial flowbore and comprising one or more ports providing a route of fluid communication between the axial flowbore and an exterior of the housing;

a first sliding sleeve, the first sliding sleeve being movable from a first position to a second position;

a second sliding sleeve, the second sliding sleeve being movable from a first position to a second position;

a chamber, the chamber being at least partially defined by the housing; and an indicator, wherein the indicator is disposed within the chamber, wherein, when the first sliding sleeve is in the first position, the ports are obstructed by the first sliding sleeve and the second sliding sleeve is retained in the first position by the first sleeve and, when the first sliding sleeve is in the second position, the ports are unobstructed by the first sliding sleeve and the second sliding sleeve is not retained in the first position by the first sleeve, and wherein, when the second sliding sleeve is in the first position, the identifier tag is retained within the chamber and, when the second sliding sleeve is in the second position, the indicator is not retained in the chamber.

Embodiment B. The wellbore servicing apparatus of embodiment A, wherein the indicator is unique to the sliding sleeve system.

Embodiment C. The wellbore servicing apparatus of one of embodiments A or B, wherein the indicator comprises a signal transmitter.

Embodiment D. The wellbore servicing apparatus of one of embodiments A through C, wherein the indicator comprises a radio-frequency identification tag, a microelectromechanical system, or combinations thereof.

Embodiment E. The wellbore servicing apparatus of one of embodiments A through D, wherein the indicator is buoyant with respect to the wellbore servicing fluid.

Embodiment F. The wellbore servicing apparatus of one of embodiments A through E, wherein the indicator is configured for detection by a detector.

Embodiment G. The wellbore servicing apparatus of one of embodiments A through F, wherein the first sliding sleeve is retained in the first position by a first at least one shear-pin, wherein the first at least one shear-pin extends between the first sliding sleeve and the housing.

Embodiment H. The wellbore servicing apparatus of embodiment G, wherein the second sliding is retained in the first position by a second at least one shear-pin, wherein the second at least one shear-pin extends between the second sliding sleeve and the first sliding sleeve.

Embodiment I. The wellbore servicing apparatus of embodiment H, wherein the second sliding sleeve is biased toward its second position by a biasing member.

Embodiment J. The wellbore servicing apparatus of embodiment I, wherein the biasing member comprises a spring.

Embodiment K. The wellbore servicing apparatus of one of embodiments A through J, wherein the first sliding sleeve comprises a seat, wherein the seat is configured to engage and retain an obturating member.

Embodiment L. A wellbore servicing method comprising:

positioning a wellbore servicing apparatus within a wellbore, the wellbore servicing apparatus comprising:

a housing, the housing defining an axial flowbore and comprising one or more ports providing a route of fluid communication between the axial flowbore and an exterior of the housing;

a first sliding sleeve, the first sliding sleeve being movable from a first position to a second position;

a second sliding sleeve, the second sliding sleeve being movable from a first position to a second position;

a chamber, the chamber being at least partially defined by the housing; and an indicator, wherein the indicator is disposed within the chamber, transitioning the first sliding sleeve from (a) the first position in which the ports are obstructed by the first sliding sleeve and the second sliding sleeve is retained in the first position by the first sleeve to (b) the second position in which the ports are unobstructed by the first sliding sleeve and the second sliding sleeve is not retained in the first position by the first sleeve;

transitioning the second sliding sleeve from (a) the first position in which the indicator is retained within the chamber to (b) the second position in which the indicator is not retained in the chamber;

verifying release of the indicator from the chamber; and communicating a wellbore servicing fluid via the ports.

Embodiment M. The method of embodiment L, wherein verifying release of the indicator comprises allowing the indicator to rise through the wellbore, reverse circulating the indicator, or combinations thereof.

Embodiment N. The method of one of embodiments L or M, wherein verifying release of the indicator comprises receiving a signal from the indicator.

Embodiment O. The method of embodiment N, wherein the signal comprises a radio wave, an acoustic signal, a wireless signal, or combinations thereof.

Embodiment P. The method of embodiment N, wherein the receipt of the signal provides an indication at the surface that the first sliding sleeve and the second sliding sleeve have both transitioned to the second position and that the ports are unobstructed.

Embodiment Q. The method of one of embodiments L through P, wherein verifying release of the indicator comprises capturing the indicator after the indicator has been released from the chamber of the wellbore servicing apparatus.

Embodiment R. The method of one of embodiments L through Q, wherein the indicator is captured at a location outside of the wellbore.

Embodiment S. The method of one of embodiments L through R, wherein the indicator is unique to the wellbore servicing apparatus.

Embodiment T. The method of one of embodiments L through S, wherein transitioning the first sliding sleeve from the first position to the second position comprises:

introducing an obturating member into the axial flowbore of the wellbore servicing apparatus, wherein the obturating member is engaged and retained by a seat;

applying a fluid pressure to the first sliding sleeve via the obturating member and the seat, wherein the application of the fluid pressure causes the first sliding sleeve to move from the first position to the second position.

Embodiment U. A wellbore servicing method comprising:

activating a downhole tool by transitioning the tool from a first mode to a second mode, wherein an indicator associated with the downhole tool is released into the wellbore upon activation of the downhole tool; and detecting the indicator at a location uphole from the downhole tool, wherein detection of the indicator provides confirmation of the activation of the downhole tool.

Embodiment V. The method of embodiment U, wherein the indicator is unique to the downhole tool.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A first wellbore servicing apparatus comprising:

a housing, the housing defining an axial flowbore and comprising one or more ports providing a route of fluid communication between the axial flowbore and an exterior of the housing;

a first sliding sleeve, the first sliding sleeve being movable from a first position to a second position;

a second sliding sleeve, the second sliding sleeve being movable from a first position to a second position;

a chamber, the chamber being at least partially defined by the housing; and an indicator, wherein the indicator is disposed within the chamber, wherein, when the first sliding sleeve is in the first position, the ports are obstructed by the first sliding sleeve and the second sliding sleeve is retained in the first position by the first sleeve and, when the first sliding sleeve is in the second position, the ports are unobstructed by the first sliding sleeve and the second sliding sleeve is not retained in the first position by the first sleeve, and wherein, when the second sliding sleeve is in the first position, the indicator is retained within the chamber and, when the second sliding sleeve is in the second position, the indicator is not retained in the chamber.

2. The wellbore servicing apparatus of claim 1, wherein the indicator is unique to the sliding sleeve system.

3. The wellbore servicing apparatus of claim 1, wherein the indicator comprises a signal transmitter.

4. The wellbore servicing apparatus of claim 1, wherein the indicator comprises a radio-frequency identification tag, a microelectromechanical system, or combinations thereof.

5. The wellbore servicing apparatus of claim 1, wherein the indicator is buoyant with respect to a wellbore servicing fluid.

6. The wellbore servicing apparatus of claim 1, wherein the indicator is configured for detection by a detector.

7. The wellbore servicing apparatus of claim 1, wherein the first sliding sleeve is retained in the first position by a first at least one shear-pin, wherein the first at least one shear-pin extends between the first sliding sleeve and the housing.

8. The wellbore servicing apparatus of claim 7, wherein the second sliding is retained in the first position by a second at least one shear-pin, wherein the second at least one shear-pin extends between the second sliding sleeve and the first sliding sleeve.

9. The wellbore servicing apparatus of claim 8, wherein the second sliding sleeve is biased toward its second position by a biasing member.

10. The wellbore servicing apparatus of claim 9, wherein the biasing member comprises a spring.

11. The wellbore servicing apparatus of claim 1, wherein the first sliding sleeve comprises a seat, wherein the seat is configured to engage and retain an obturating member.

12. A wellbore servicing system comprising:

a wellbore tubular disposed within a wellbore;

the wellbore servicing apparatus of claim 1; and a second wellbore servicing apparatus, the second wellbore servicing apparatus comprising:

a housing, the housing of the second wellbore servicing apparatus defining an axial flowbore and comprising one or more ports providing a route of fluid communication between the axial flowbore of the second wellbore servicing apparatus and an exterior of the housing of the second wellbore servicing apparatus;

a first sliding sleeve, the first sliding sleeve of the second wellbore servicing apparatus being movable from a first position to a second position;

a second sliding sleeve, the second sliding sleeve of the second wellbore servicing apparatus being movable from a first position to a second position;

a chamber, the chamber of the second wellbore servicing apparatus being at least partially defined by the housing of the second wellbore servicing apparatus; and an indicator, wherein the indicator of the second wellbore servicing apparatus is disposed within the chamber of the second wellbore servicing apparatus, wherein, when the first sliding sleeve of the second wellbore servicing apparatus is in the first position, the ports of the second wellbore servicing apparatus are obstructed by the first sliding sleeve of the second wellbore servicing apparatus and the second sliding sleeve of the second wellborn servicing apparatus is retained in the first position by the first sleeve of the second wellbore servicing apparatus and, when the first sliding sleeve of the second wellbore servicing apparatus is in the second position, the ports of the second wellbore servicing apparatus are unobstructed by the first sliding sleeve of the second wellbore servicing apparatus and the second sliding sleeve of the second wellbore servicing apparatus is not retained in the first position by the first sleeve of the second wellbore servicing apparatus, and wherein, when the second sliding sleeve of the second wellbore servicing apparatus is in the first position, the indicator of the second wellbore servicing apparatus is retained within the chamber of the second wellbore servicing apparatus and, when the second sliding sleeve of the second wellbore servicing apparatus is in the second position, the indicator of the second wellbore servicing apparatus is not retained in the chamber of the second wellbore servicing apparatus, wherein the indicator of the first wellbore servicing apparatus is unique to the first wellbore servicing apparatus, and wherein the indicator of the second wellbore servicing apparatus is unique to the second wellbore servicing apparatus.

13. A wellbore servicing method comprising:

positioning a first wellbore servicing apparatus within a wellbore, the first wellbore servicing apparatus comprising:

a housing, the housing defining an axial flowbore and comprising one or more ports providing a route of fluid communication between the axial flowbore and an exterior of the housing;

a first sliding sleeve, the first sliding sleeve being movable from a first position to a second position;

a second sliding sleeve, the second sliding sleeve being movable from a first position to a second position;

a chamber, the chamber being at least partially defined by the housing; and an indicator, wherein the indicator is disposed within the chamber, transitioning the first sliding sleeve from (a) the first position in which the ports are obstructed by the first sliding sleeve and the second sliding sleeve is retained in the first position by the first sleeve to (b) the second position in which the ports are unobstructed by the first sliding sleeve and the second sliding sleeve is not retained in the first position by the first sleeve;

transitioning the second sliding sleeve from (a) the first position in which the indicator is retained within the chamber to (b) the second position in which the indicator is not retained in the chamber;

verifying release of the indicator from the chamber; and communicating a wellbore servicing fluid via the ports.

14. The method of claim 13, wherein verifying release of the indicator comprises allowing the indicator to rise through the wellbore, reverse circulating the indicator, or combinations thereof.

15. The method of claim 13, wherein verifying release of the indicator comprises receiving a signal from the indicator.

16. The method of claim 15, wherein the signal comprises a radio wave, an acoustic signal, a wireless signal, or combinations thereof.

17. The method of claim 15, wherein the receipt of the signal provides an indication at the surface that the first sliding sleeve and the second sliding sleeve have both transitioned to the second position and that the ports are unobstructed.

18. The method of claim 13, wherein verifying release of the indicator comprises capturing the indicator after the indicator has been released from the chamber of the wellbore servicing apparatus.

19. The method of claim 18, wherein the indicator is captured at a location outside of the wellbore.

20. The method of claim 13, wherein the indicator is unique to the wellbore servicing apparatus.

21. The method of claim 13, wherein transitioning the first sliding sleeve from the first position to the second position comprises:

introducing an obturating member into the axial flowbore of the wellbore servicing apparatus, wherein the obturating member is engaged and retained by a seat;

applying a fluid pressure to the first sliding sleeve via the obturating member and the seat, wherein the application of the fluid pressure causes the first sliding sleeve to move from the first position to the second position.

22. The wellbore servicing method of claim 13, further comprising:

positioning a second wellbore servicing apparatus within a wellborn, the second wellbore servicing apparatus comprising:

a housing, the housing of the second wellbore servicing apparatus defining an axial flowbore and comprising one or more ports providing a route of fluid communication between the axial flowbore of the second wellbore servicing apparatus and an exterior of the housing of the second wellborn servicing apparatus;

a first sliding sleeve, the first sliding sleeve of the second wellbore servicing apparatus being movable from a first position to a second position;

a second sliding sleeve, the second sliding sleeve of the second wellbore servicing apparatus being movable from a first position to a second position;

a chamber, the chamber of the second wellbore servicing apparatus being at least partially defined by the housing of the second wellbore servicing apparatus; and an indicator, wherein the indicator of the second wellbore servicing apparatus is disposed within the chamber of the second wellbore servicing apparatus, transitioning the first sliding sleeve of the second wellbore servicing apparatus from (a) the first position in which the ports of the second wellbore servicing apparatus are obstructed by the first sliding sleeve of the second wellbore servicing apparatus and the second sliding sleeve of the second wellbore servicing apparatus is retained in the first position by the first sleeve of the second wellbore servicing apparatus to (b) the second position in which the ports of the second wellbore servicing apparatus are unobstructed by the first sliding sleeve of the second wellbore servicing apparatus and the second sliding sleeve of the second wellbore servicing apparatus is not retained in the first position by the first sleeve of the second wellbore servicing apparatus;

transitioning the second sliding sleeve of the second wellbore servicing apparatus from (a) the first position in which the indicator of the second wellbore servicing apparatus is retained within the chamber of the second wellbore servicing apparatus to (b) the second position in which the indicator of the second wellbore servicing apparatus is not retained in the chamber of the second wellbore servicing apparatus;

verifying release of the indicator of the second wellbore servicing apparatus from the chamber of the second wellbore servicing apparatus; and communicating a wellbore servicing fluid via the ports of the second wellborn servicing apparatus, wherein the indicator of the first wellbore servicing apparatus is unique to the first wellbore servicing apparatus, and wherein the indicator of the second wellbore servicing apparatus is unique to the second wellbore servicing apparatus.

23. A wellbore servicing method comprising:

activating a first downhole tool by transitioning the first downhole tool from a first mode to a second mode, wherein transitioning the first downhole tool from the first mode to the second mode comprises at least one of applying hydraulic pressure to an axial flowbore of the first downhole tool and engaging a mechanical shifting tool with the first downhole tool, and wherein an indicator associated with the first downhole tool is released into the wellbore upon activation of the first downhole tool; and detecting the indicator at a location uphole from the first downhole tool, wherein the indicator comprises a signal transmitter, and wherein detection of the indicator provides confirmation of the activation of the first downhole tool;

and wherein the indicator is unique to the first downhole tool.

24. The wellbore servicing method of claim 23, further comprising:

activating a second downhole tool by transitioning the second downhole tool from a first mode to a second mode, wherein transitioning the second downhole tool from the first mode to the second mode comprises at least one of applying hydraulic pressure to an axial flowbore of the second downhole tool and engaging a mechanical shifting tool with the second downhole tool, and wherein an indicator associated with the second downhole tool is released into the wellbore upon activation of the second downhole tool; and detecting the indicator associated with the second downhole tool at a location uphole from the second downhole tool, wherein the indicator associated with the second downhole tool comprises a signal transmitter, and wherein detection of the indicator associated with the second downhole tool provides confirmation of the activation of the second downhole tool;

and wherein the indicator associated with the second downhole tool is unique to the second downhole tool.

* * * * *

UNITED STATES PATENT AND TRADEMARK OFFICE

CERTIFICATE OF CORRECTION

PATENT NO. : 8,826,980 B2
APPLICATION NO. : 13/434584
DATED : September 9, 2014
INVENTOR(S) : Adam Kent Neer It is certified that error appears in the above-identified patent and that said Letters Patent is hereby corrected as shown below:

In the Claims:

Column 21, Claim 12, line 18, replace "second wellborn" with --second wellbore--.

Column 22, Claim 22, line 47, replace "second wellborn" with --second wellbore--.

Signed and Sealed this
Second Day of December, 2014

Michelle K. Lee

Michelle K. Lee
*Deputy Director of the United States Patent and Trademark Office*